United States Patent [19]

Ferrazzi

[11] Patent Number: 5,012,783

[45] Date of Patent: May 7, 1991

[54] CYLINDER HEAD FOR AN INTERNAL COMBUSTION ENGINE WITH FIVE VALVES PER CYLINDER

[75] Inventor: Francesco Ferrazzi, Turin, Italy

[73] Assignee: Fiat Auto S.p.A., Turin, Italy

[21] Appl. No.: 562,990

[22] Filed: Aug. 6, 1990

[30] Foreign Application Priority Data

Aug. 4, 1989 [IT] Italy ..... 67684 A/89

[51] Int. Cl.[5] ..... F01L 1/26

[52] U.S. Cl. ..... 123/432; 123/90.41

[58] Field of Search ..... 123/90.44, 90.41, 432, 123/308

[56] References Cited

U.S. PATENT DOCUMENTS 4,617,881 10/1986 Aoi et al. ..... 123/90.44
4,624,222 11/1986 Yoshikawa ..... 123/90.44
4,637,356 1/1987 Kuroda ..... 123/90.44

*Primary Examiner*—E. Rollins Cross
*Attorney, Agent, or Firm*—Sughrue, Mion, Zinn Macpeak & Seas

[57] ABSTRACT

The axes of the three inlet valves associated with each cylinder of an internal combustion engine are parallel to each other. The valves are all operated by the same camshaft which acts on the three valves from above through three interposed rocker arms. The rocker arm of the valve which is in the intermediate position is in a reverse orientation relative to the other two rocker arms.

2 Claims, 2 Drawing Sheets

CYLINDER HEAD FOR AN INTERNAL COMBUSTION ENGINE WITH FIVE VALVES PER CYLINDER

DESCRIPTION

The present invention relates to a cylinder head for an internal combustion engine, of known type including, in correspondence with each cylinder:

three inlet ducts which open in the surface of the cylinder head facing the cylinder, in a surface portion which is inclined to the general plane of the surface, three inlet valves associated with the inlet ducts, the axes of two of the inlet valves being contained in a plane substantially perpendicular to the inclined surface portion, the axis of the third inlet valve being separate from the plane containing the axes of the other two inlet valves, a camshaft which operates all three inlet valves from above by means of respective interposed rocker arms, each of which is associated with the stem of the respective inlet valve at one end and a tappet for taking up the valve clearance at its other end.

In a cylinder head of the known type described above, the axis of the third inlet valve is inclined to the plane containing the axes of the other two inlet valves so that the three upper ends of the stems of the three inlet valves are aligned with each other and can be operated by the camshaft. This conventional solution has the disadvantage that it requires more complex working. Moreover, the configuration of the inclined surface portion, which constitutes part of the top of the combustion chamber, is quite complex and irregular since the surface must be perpendicular to the valve axis in correspondence with each of the three inlet valves (whose axes are not all parallel).

In order to resolve the above problems, the subject of the invention is a cylinder head of the type indicated above, characterised in that the axis of the third inlet valve is parallel to the plane containing the axes of the other two inlet valves, and in that the rocker arm associated with the third inlet valve is in a reverse orientation relative to the other two rocker arms, that is, its end which bears on the respective valve is on the same side as the ends of the other two rocker arms which bear on the respective tappets, and vice versa.

By virtue of the above characteristic, it is possible to use three valves all with parallel axes, resulting in the elimination of the problems indicated above and at the same time enabling all three valves to be operated by the same camshaft.

Figure 2:
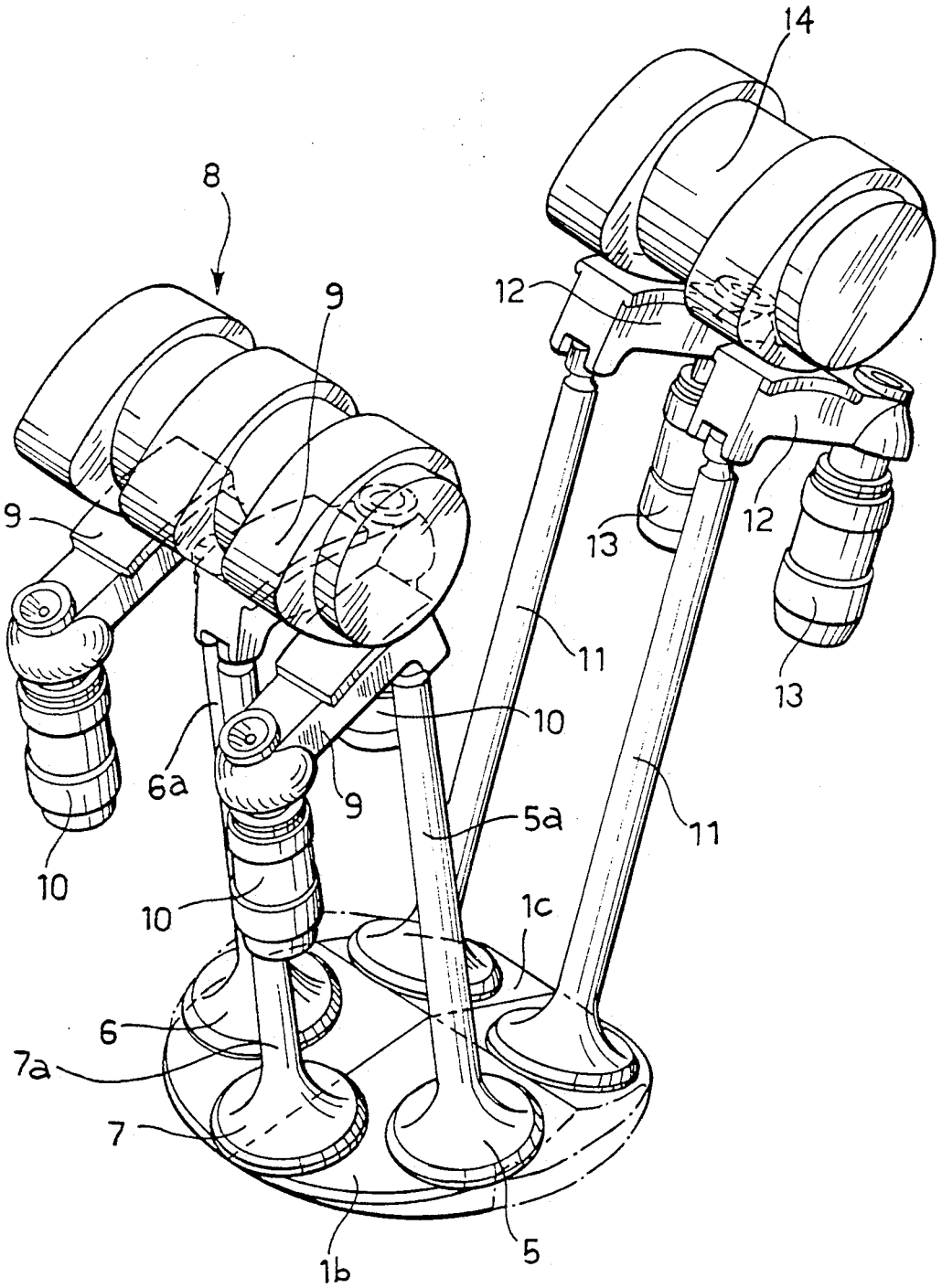
Figure 1:
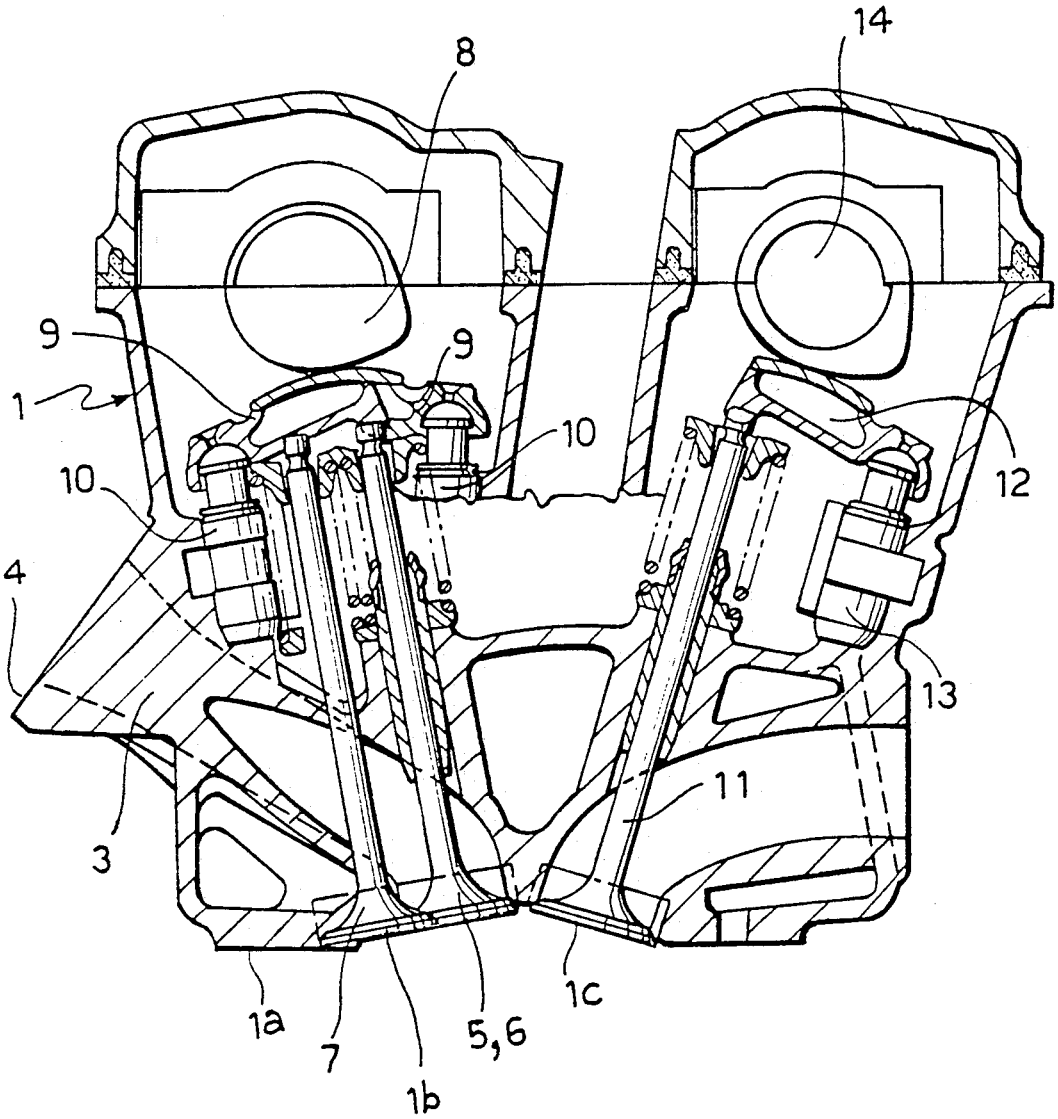

Further characteristics and advantages of the invention will become clear from the description which follows with reference to the appended drawings, provided by way of non-limiting example, in which:

FIG. 1 is a sectional view of a cylinder head according to the invention, and FIG. 2 is a perspective view showing the valve assembly associated with each cylinder of the engine, on an enlarged scale.

With reference to the drawings, a cylinder head 1 includes a surface 1*a* which is intended to face the cylinders of the engine block. In correspondence with each cylinder, the surface 1*a* has two surface portions 1*b* and 1*c* which are inclined in a roof-like manner and define the combustion chamber associated with the cylinder. Three inlet ducts 3 open in the inclined surface portion 1*b* and at their other ends open in a side wall 4 of the head 1. Three mushroom-shaped inlet valves 5, 6, 7 are associated with the inlet ducts 3. The stems 5*a*, 6*a* of the two valves 5, 6 are arranged at the two ends of the surface portion 1*b* and lie in the same plane perpendicular to that surface portion. A third valve 7 is situated in a central region of the surface portion 1*b* and the axis of its stem 7*a* is parallel to the axes of the stems 5*a*, 6*a*. The same camshaft 8 acts on the upper ends of the three stems 5*a*, 6*a*, 7*a* from above by means of respective interposed rocker arms 9, each of which has one end bearing on the respective valve stem and its other end bearing on a tappet 10 for taking up the valve clearance.

In order to enable the three valves to be operated by the same camshaft in spite of the fact that the stems of the three valves are parallel but not in the same plane, the rocker arm 9 associated with the valve 7 is in the opposite orientation from the other two rocker arms 9, that is, its end which bears on the respective stem 7*a* is on the side where the other two rocker arms bear on their tappets 10. On the other hand, the rocker arm 9 associated with the valve 7 bears on the respective tappet 10 on the side where the other two rocker arms 9 bear on the respective valves 5, 6.

FIGS. 1 and 2 also show the exhaust valves 11 which are associated with each cylinder and are operated by a camshaft 14 through two rocker arms 12 and respective tappets 13.

For clarity, FIG. 2, which was produced by a computer, shows the space of the combustion chamber defined by the surfaces 1*b* and 1*c* as a solid block.

Naturally, the principle of the invention remaining the same, the forms of embodiment and details of construction may be varied widely with respect to those described and illustrated purely by way of example, without thereby departing from the scope of the present invention.

I claim:

1. A cylinder head for an internal combustion engine, including, for each cylinder:

three inlet ducts which open in the surface of the cylinder head facing the cylinder, in a surface portion which is inclined to the general plane of the surface, three inlet valves associated with the inlet ducts, the axes of two of the inlet valves being contained in a plane substantially perpendicular to the inclined surface portion, the axis of the third inlet valve being separate from the plane containing the axes of the other two inlet valves, a camshaft which operates all three inlet valves from above by means of respective interposed rocker arms, each of which bears on the stem of the respective inlet valve at one end and on a tappet for taking up the valve clearance at its other end.

wherein the axis of the third inlet valve is parallel to the plane containing the axes of the other two inlet valves and the rocker arm associated with the third inlet valve is in a reverse orientation relative to the other two rocker arms, that is, its end which bears on the respective valve is on the side where the other two rocker arms bear on the respective tappets.

2. A cylinder head according to claim 1, wherein the axis of the third inlet valve is contained in the plane of symmetry of the inclined surface portion, whilst the axes of the other two inlet valves are situated on either side of the plane of symmetry.

* * * * *